US007270385B2

(12) United States Patent
Mathur et al.

(10) Patent No.: US 7,270,385 B2
(45) Date of Patent: Sep. 18, 2007

(54) SPILL PROOF SHELF ASSEMBLY METHOD AND STRUCTURE

(75) Inventors: Rakesh Mathur, Brookfield, WI (US); Carl Tobert Whitaker, LaGrange, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/074,245

(22) Filed: Feb. 12, 2002

(65) Prior Publication Data

US 2003/0151340 A1 Aug. 14, 2003

(51) Int. Cl.
*A47B 96/00* (2006.01)

(52) U.S. Cl. ..... 312/408; 108/108

(58) Field of Classification Search ..... 248/235, 248/241, 243; 312/408, 404, 351; 108/107, 108/108

See application file for complete search history.

(56) References Cited

U.S. PATENT DOCUMENTS

| | | | | |
|---|---|---|---|---|
| 2,997,356 | A | 8/1961 | Hilliker et al. | |
| 3,690,744 | A | 9/1972 | Squire | |
| 3,984,163 | A | 10/1976 | Boorman, Jr. et al. | |
| 4,123,130 | A | 10/1978 | Locke | |
| 4,190,305 | A | 2/1980 | Knight et al. | |
| 4,735,470 | A * | 4/1988 | Falk | 312/246 |
| 4,736,997 | A | 4/1988 | Besore et al. | |
| 4,815,685 | A | 3/1989 | Roberts et al. | |
| 5,004,302 | A | 4/1991 | Stocking et al. | |
| 5,228,764 | A | 7/1993 | Cherry et al. | |
| 5,273,354 | A * | 12/1993 | Herrmann et al. | 312/408 |
| 5,340,209 | A | 8/1994 | Kolbe et al. | |
| 5,346,299 | A | 9/1994 | Werkmeister et al. | |
| 5,486,046 | A | 1/1996 | Jernstrom et al. | |
| 5,516,204 | A | 5/1996 | Calvert et al. | |
| 5,524,981 | A | 6/1996 | Herrmann et al. | |
| 5,540,493 | A | 7/1996 | Kane et al. | |
| 5,641,217 | A * | 6/1997 | Caruso et al. | 312/404 |
| 5,735,589 | A | 4/1998 | Herrmann et al. | |
| 5,813,741 | A | 9/1998 | Fish et al. | |
| 5,893,620 | A | 4/1999 | Birgelis | |
| 6,056,378 | A * | 5/2000 | Semon et al. | 312/246 |
| 6,105,233 | A | 8/2000 | Neal | |
| 6,186,456 | B1 * | 2/2001 | Marsh | 248/243 |
| 6,227,636 | B1 * | 5/2001 | Lye et al. | 312/408 |
| 6,364,136 | B1 * | 4/2002 | Weshler et al. | 211/90.02 |
| 6,364,273 | B1 * | 4/2002 | Otema | 248/444.1 |
| 6,422,673 | B1 * | 7/2002 | Bienick | 312/408 |
| 6,457,790 | B1 * | 10/2002 | Liang et al. | 312/334.46 |
| 6,497,185 | B1 * | 12/2002 | Barrett et al. | 108/108 |

* cited by examiner

*Primary Examiner*—Anita King
*Assistant Examiner*—Steven M. Marsh
(74) *Attorney, Agent, or Firm*—George L. Rideout, Esq.; Armstrong Teasdale LLP

(57) ABSTRACT

A system for limiting outward movement of a slide-out shelf includes a plurality of side supports configured to support the shelf, a positive stop extending along each of the side supports, and a plurality of support members configured to rigidly connect the side supports and contact at least a portion of the shelf thereby blocking forward movement of the shelf.

17 Claims, 5 Drawing Sheets

SPILL PROOF SHELF ASSEMBLY METHOD AND STRUCTURE

BACKGROUND OF THE INVENTION

This invention relates generally to shelves and, more particularly, to extendible shelves for use in refrigerators.

One type of extendible or "slide-out" refrigerator shelf assembly includes slide mechanisms and latch springs that engage a portion of a shelf when the shelf is in an extended position. The latch springs restrict movement of the shelf beyond a predetermined position and releasably hold the shelf in an extended position. See, for example, U. S. Pat. No. 5,340,209.

Removal of slide out refrigerator shelves, however, is problematic because the slide mechanisms for the shelves must support the shelf in a fully or partially extended position and thus must securely couple the shelf to shelf supports. Consequently, removal or separation of the shelf from the supports is intricate and often awkward. Some removable slide-out shelves require extension of the shelf substantially beyond a normal fully extended position to release the shelf from the shelf supports. However, consumer confidence may decrease if the shelf becomes unbalanced.

BRIEF SUMMARY OF THE INVENTION

In one aspect, a system for limiting outward movement of a slide-out shelf includes a plurality of side supports configured to support the shelf, a positive stop extending along each of the side supports, and a plurality of support members configured to rigidly connect the side supports and contact at least a portion of the shelf thereby blocking forward movement of the shelf.

In another aspect, a method for assembling a shelf assembly is provided. The method includes providing a shelf that includes a forward edge, at least one forward tab and at least one rear tab, providing at least one side support including at least one side support clearance, at least one gusset and at least one rear positive stop, and slidably coupling the shelf to the side supports.

In another aspect, a slide-out refrigerator shelf assembly includes a shelf including a first side, a forward tab laterally extending a first distance from the first side, and a rear tab laterally extending a second distance from the first side, the second distance less than the first distance. The shelf assembly also includes a first shelf side support comprising a laterally projecting ledge for sliding engagement with the shelf first side and the projecting ledge includes a rear portion having a first width sufficient to retain the rear tab, a forward portion having a second width less than the first width and providing a clearance for the rear tab and further providing a clearance for the forward tab, the clearance having a third width providing a clearance for the forward tab.

DETAILED DESCRIPTION OF THE INVENTION

Figure 1:
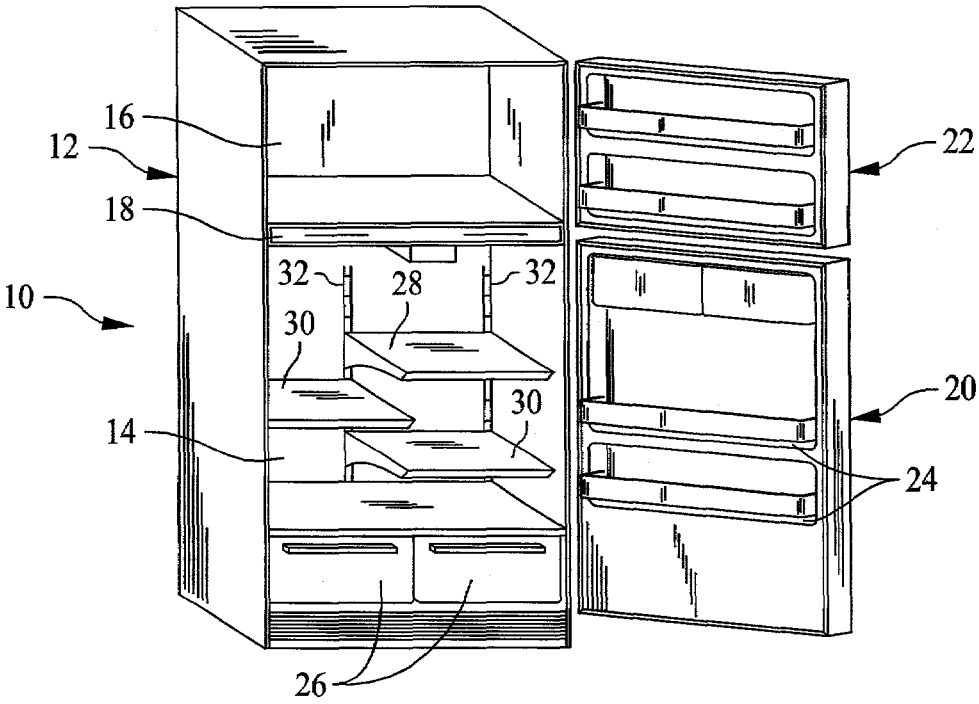
FIG. 1 is a front perspective view of an exemplary refrigerator including an exemplary slide out shelf assembly.

FIG. 1 is a perspective view of an exemplary large top mount refrigerator 10 including an outer cabinet 12 including a fresh food compartment 14 and a freezer compartment 16 separated by an internal wall 18. A fresh food door 20 and a freezer door 22 provide access to fresh food compartment 14 and to the freezer compartment 16, respectively. Fresh food door 20 typically includes a number of shelves 24 for storage of foodstuffs. A number of storage drawers 26 are provided in the lower portion of fresh food compartment 14, and a plurality of vertically adjustable shelf assemblies 28 and 30 on two rails 32 are provided in the upper portion of fresh food compartment 14. Shelf assembly 28 is a slide-out shelf assembly in a retracted position, and is selectively positionable from a retracted position (shown in FIG. 1) to an extended position (described below) to allow convenient access to items placed upon shelf assembly 28.

While described and illustrated in the exemplary context of a middle shelf of a top mount refrigerator, it is contemplated that shelf assembly 28 could be used in other applications, including but not limited to other types of refrigerators, such as side-by-side refrigerators, as well as slide-out shelves, drawers, and bin assemblies for use in a wide variety of products of general application. As the benefits of the present invention accrue to uses well beyond use as a refrigerator shelf, the present invention is not limited to specific application in a refrigerator, such as, for example, refrigerator 10.

Figure 2:
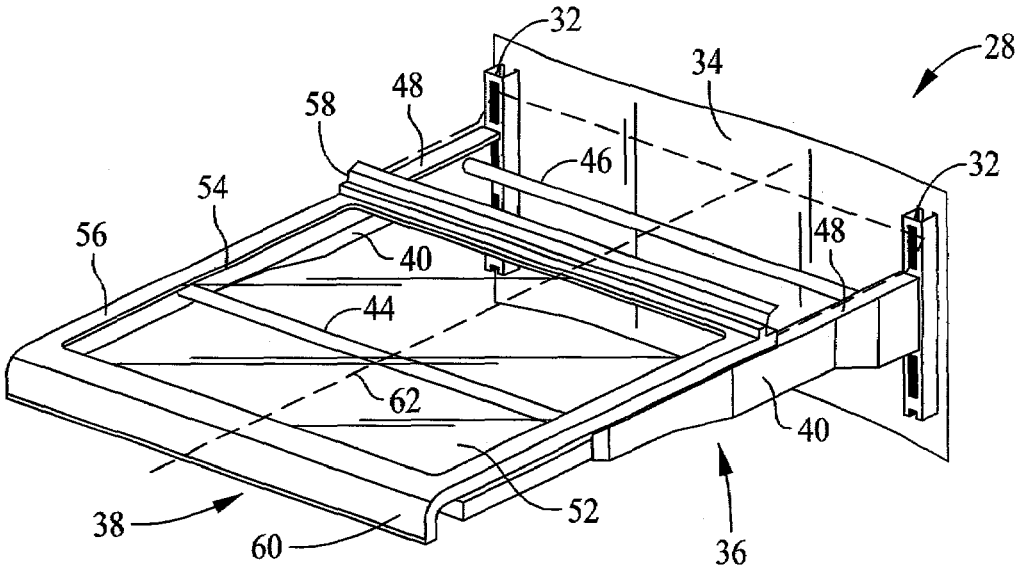
FIG. 2 is a perspective view of the slide-out shelf assembly shown in FIG. 1 in an extended position.

FIG. 2 is a perspective view of slide-out shelf assembly 28 in an extended position. Shelf assembly 28 is mounted on rails 32 attached to a rear wall 34 of fresh food compartment 14 (shown in FIG. 1). Shelf assembly 28 includes a support frame 36 and a glass encapsulated shelf 38. Frame 36 includes two side supports 40, a forward support member 44 and a rear support member 46. Support members 44, 46 rigidly connect side supports 40. Each side support 40 includes a horizontally inwardly projecting doubly stepped flange or ledge 48, upon which shelf 38 slides. Shelf 38 includes a rectilinear transparent plate 52 held within grooves 54 of a surrounding rim 56 fabricated from a suitable plastic material such as, for example, acrylonitrile-butadiene-styrene (ABS) or high impact polystyrene (HIPS). An anti-spill guard 58 is positioned across the rear of rim 56 and is integral with rim 56. In an alternative embodiment, shelf 38 includes rectilinear transparent plate 52 held within grooves 54 of surrounding rim 56 by an ultrasound weld. A forward edge of rim 56 curves downwardly forming a handle 60 which a user may grasp to move shelf 38 between the extended position and the retracted position (shown in FIG. 1) wherein anti-spill guard 58 is positioned substantially adjacent rear wall 34. In one embodiment, rim 56 is substantially symmetrical about a longitudinal axis 62.

Figure 3:
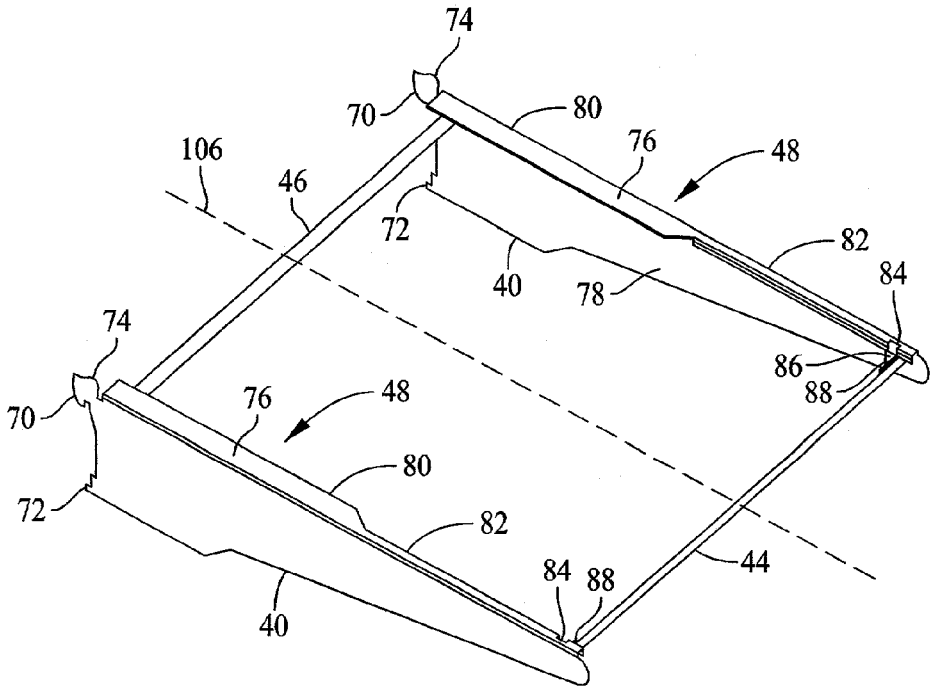
FIG. 3 is a top perspective view of the support frame shown in FIG. 2.
Figure 4:
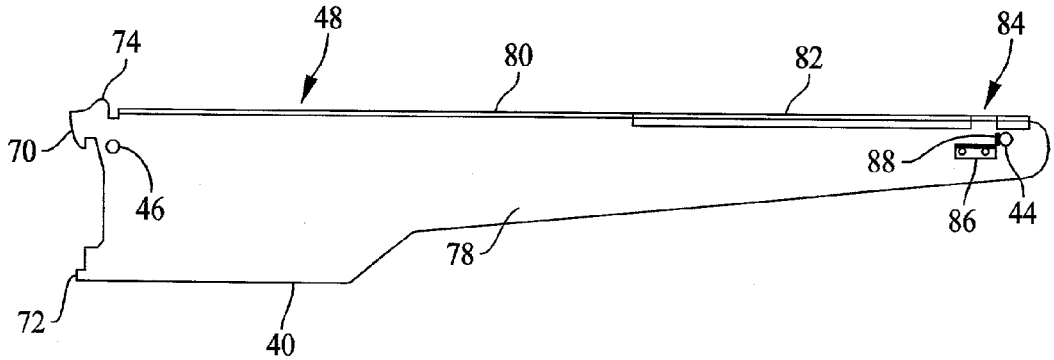
FIG. 4 is a side view of the support frame shown in FIG. 2.

FIG. 3 is a top perspective view and FIG. 4 is a side view of support frame 36. Each side support 40 includes a hook 70, a projection 72, and a rear stop 74 for engagement with vertical rails 32 (shown in FIG. 2) to hold shelf assembly 28 (shown in FIG. 2) at a selected elevation. In case of improper shelf installation, rear stops 74 facilitate preventing dislodgment of support frame 36 from rails 32.

Each ledge 48 includes a surface 76 upon which shelf 38 (shown in FIG. 2) may slide. An inner surface 78 of supports 40 is substantially perpendicular to ledges 48, and shelf 38 is retained to side supports 40 partially above and partially below ledges 48 and between inner surfaces 78 as described further below. Each ledge 48 further includes a rear portion 80 having a first width, a forward portion 82 having a second width smaller than the first width, and a track clearance 84 having a third width smaller than the second width. A gusset 86 extends laterally inward from the forward portion 82 of each side support 40 and includes an integral tab 88 extending upwardly from gusset 86. Tabs 88 are substantially adjacent to support member 44, and together facilitate preventing shelf 38 from extending beyond a fully a fully extended position.

Figure 5:
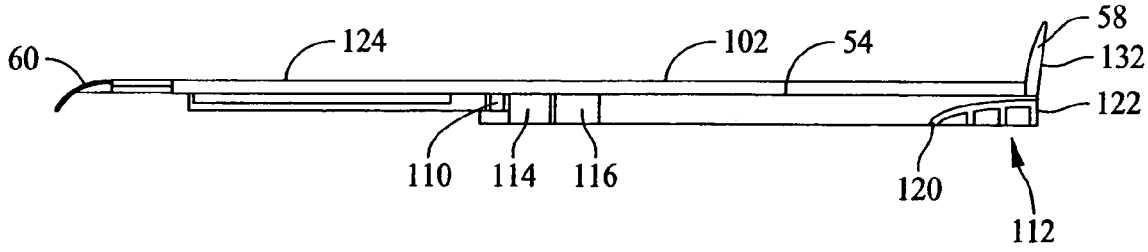
FIG. 5 is a side view of the shelf rim shown in FIG. 1.
Figure 6:
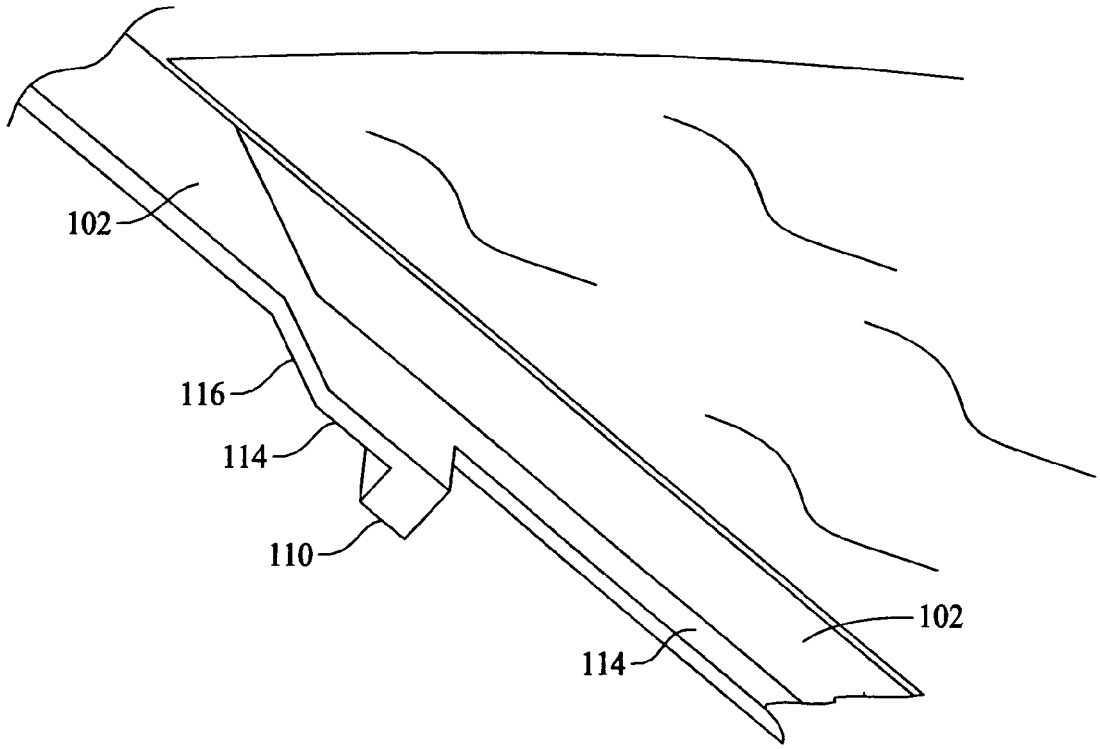
FIG. 6 is a partial magnified bottom perspective view of the middle portion of the shelf shown in FIG. 5.
Figure 7:
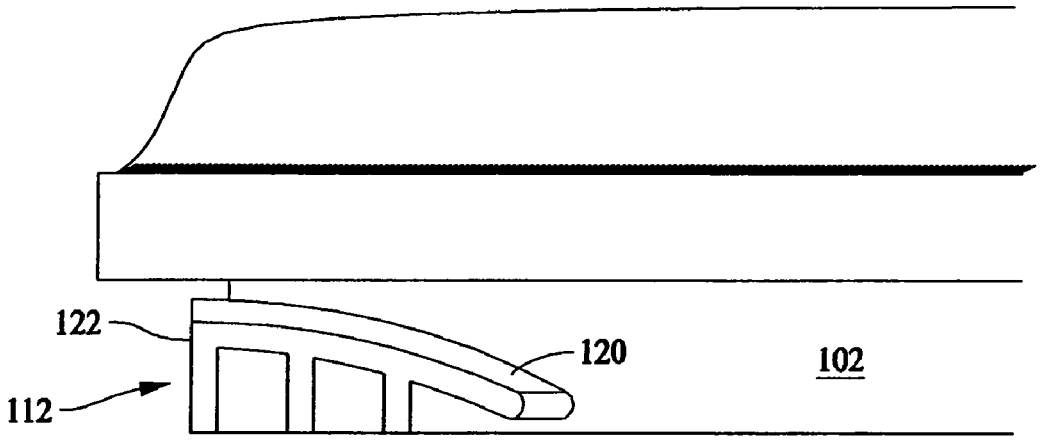
FIG. 7 is a partial magnified bottom perspective view of the rear portion of the shelf shown in FIG. 6.

FIG. 5 is a side view of shelf rim 56 including two lateral projections, namely, a forward stop tab 110 and a rear tab 112 extending from a side edge 102 below groove 54. FIGS. 6 and 7 provide magnified bottom perspective views of both forward stop tab 110 and rear tab 112. Forward stop tab 110 extends laterally outward, i.e., away from shelf longitudinal axis 106 (shown in FIG. 3) from a lower portion 114 of side edge 102 for a first distance. Lower portion 114 is inwardly spaced from upper edges of 102 to form a sliding surface that rest upon surfaces 76 (shown in FIG. 3) of side support 40 (shown in FIG. 3) when shelf 38 (shown if FIG. 2) is installed in support frame 36 (shown in FIG. 2). Forward stop tab 110 includes sloped sides 116 to facilitate smooth movement of shelf 38 between extended and retracted positions and provides support to forward stop tabs 110. Sloped sides 116 facilitate the prevention of jamming shelf 38 in side supports 40 and gently direct shelf 38 into an advantageous centered position relative to side supports 40 as shelf 38 is moved relative to support frame 36.

Rear tab 112 extends laterally outward away from shelf longitudinal axis 106 (shown in FIG. 3) from side edge 102 for a second distance less than the first distance for which forward stop tab 110 extends. In one embodiment, rear tab 112 extends laterally outward a distance equal to distance for which forward stop tab 110 extends. Additionally, rear tab 112 extends parallel with axis 106 and rear tab 112 includes a forward lip 120 and rear portion 122. Anti-spill guard 58 extends obliquely from a top surface 124 of rim 56, and rounded forward edge 60 extends downward from rim top surface 124. Anti spill guard 58 laterally extends above rim top surface 124 substantially the entire width of rim 56, and includes flared sides 132 to prevent jamming of anti-spill guard 58 when shelf 38 (shown in FIG. 2) is installed onto support frame 36 (shown in FIGS. 2).

Figure 8:
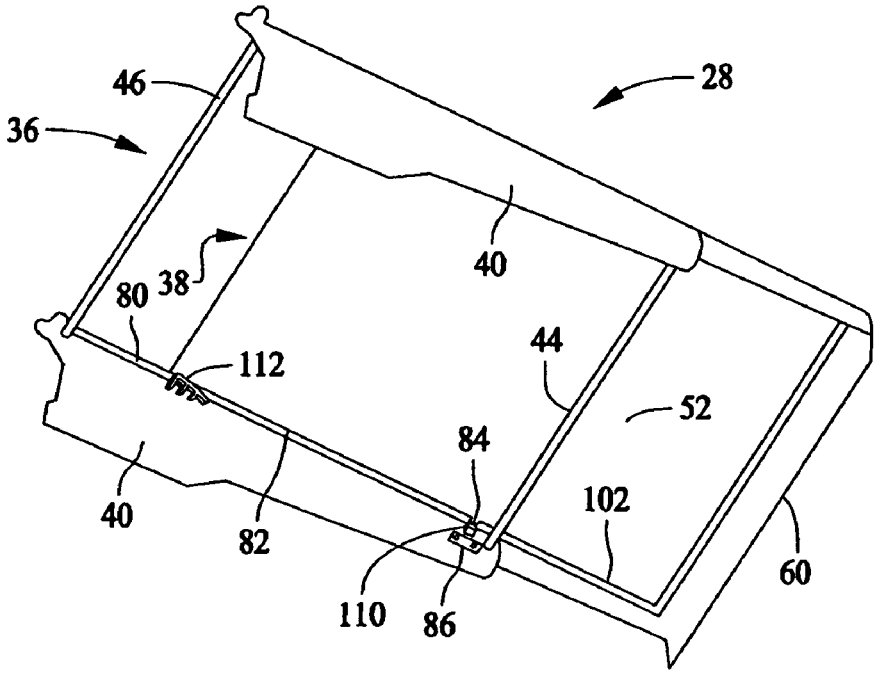
FIG. 8 is a bottom perspective view of the shelf assembly shown in FIG. 2.
Figure 9:
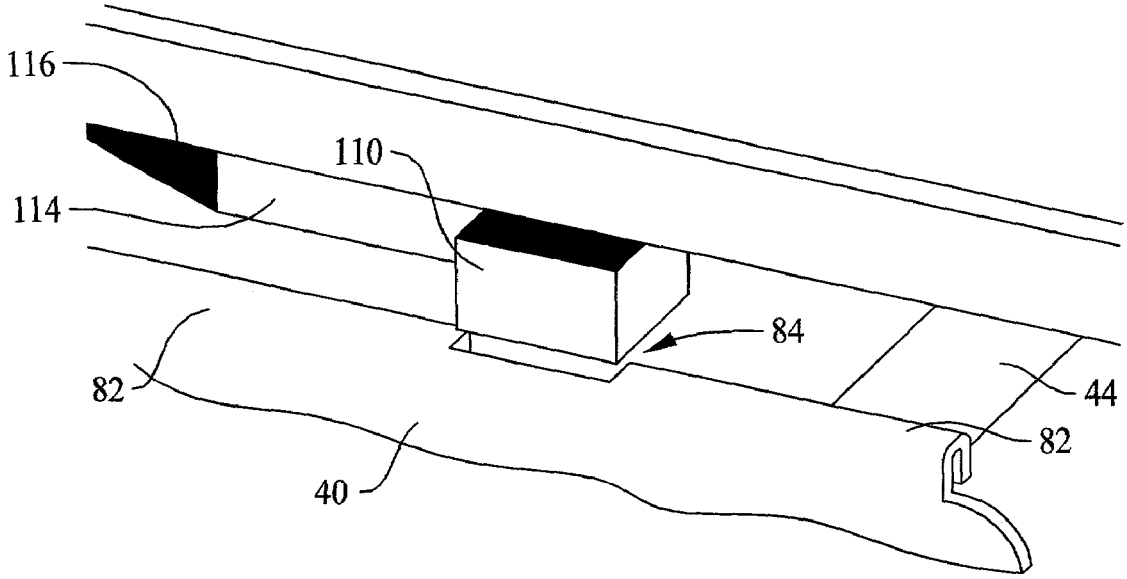
FIG. 9 is a partial magnified perspective view of the forward portion of FIG. 8.

FIG. 8 is a bottom perspective view of shelf assembly 28 in the extended position with left side edge 102 broken away, and FIG. 9 is a magnified perspective view of a portion of FIG. 8 illustrating the release of shelf forward stop tab 110 from side support 40. When shelf 38 is extended, forward stop tab 110 contacts gusset tab 88 (shown in FIG. 4) and support member 44 and prevents further outward movement or extension of shelf 38, and rear tabs 112 are positioned below side support ledge rear portion 80 so that shelf 38 is securely retained to side supports 40. The engagement of the forward stop tab 110 to gusset tab 88 and support member 44, respectively, communicate to the users that the shelf is fully extended. Additionally, the proximity of rear tab 112 to side support ledge forward portion 82 allows full release of shelf 38 only after following the below-described steps for removal.

Full release of shelf 38 is facilitated by pulling rim forward edge 60 of shelf 38 and positioning forward stop tabs 110 just below track clearances 84. Track clearances 84 are located adjacent on the front side of support member 44 and above gusset 88. Lifting rim forward edge 60 upwards when forward stop tabs 110 are located at track clearance 84 releases the forward portion of shelf 38 from side supports 40. By further pulling shelf 38 longitudinally away from side supports 40, rear tabs 112 reach a release position (not shown) in which rear tabs 112 are positioned forward of side support ledge rear portions 80 and within side support ledge forward portions 82 that are dimensioned to provide a lateral clearance for rear tabs 112. Shelf 38 may therefore be released by lifting rear tabs 112 upward and through side support ledge forward portions 82.

In one embodiment, a release position is provided wherein the extension is reduced by 2.54 centimeters of the normal fully extended position, and conveniently assures the user that full extension is achieved and stable. Once the release position is obtained, shelf 38 may be fully removed from side supports 40 by lifting shelf 38 upward and away from side supports 40. In another embodiment, the extension is reduced by other than 2.54 centimeters.

Return or installation of shelf 38 is accomplished by inserting rear tabs 112 in side support ledge forward portions 82, inserting forward stop tabs 110 into track clearances 84 and sliding shelf 38 backward over side supports 40 until shelf 38 is in a fully retracted position. Installation and removal of shelf 38 may be accomplished with one hand.

Thus, an extendible shelf assembly 28 is provided that securely couples shelf 38 to side supports 40 while allowing a user to remove and reinstall shelf 38 from side supports 40 quickly and easily as desired such as, for example, cleaning of shelf 38. The deliberate extension required to place shelf 38 in the fully extended position relative to the release position allows shelf 38 to be extended back and forth with increased consumer confidence. Accordingly, a reliable and cost efficient shelf is provided. The shelf is a securely mountable and easily extendible slide-out shelf that is easily removed.

While the invention has been described in terms of various specific embodiments, those skilled in the art will recognize that the invention can be practiced with modification within the spirit and scope of the claims.

What is claimed is:

1. A system for limiting outward movement of a slide-out shelf, wherein the shelf includes at least one projecting forward stop tab and at least one rear tab, said system comprising:

a plurality of side supports configured to support the shelf, each said side support comprising a ledge comprising:

a rear portion having a first width sufficient to retain the rear tab;

a forward portion having a second width less than said first width and sufficient to retain the forward stop tab, each of said rear portion and said forward portion including a top surface and an opposing bottom surface, wherein said forward portion is configured to provide a clearance for the rear tab and to further provide a clearance portion having a third width less than said second width, said clearance portion defining an opening extending through said top surface and said bottom surface, wherein said clearance portion is configured to provide a clearance for receiving the forward stop tab;

a plurality of support members configured to rigidly connect said side supports and contact at least a portion of the shelf thereby blocking forward movement of the shelf;

a plurality of gussets extending inwardly from each of said side supports; and a gusset tab extending upwardly from each of said gussets and aligned substantially vertically below said clearance portion, said gusset tab configured to contact the stop tab of the shelf thereby blocking further forward movement of the shelf.

2. A system in accordance with claim 1 wherein said portion of the shelf comprises at least one of a forward stop tab and a rear tab, whereby said tabs are at least one of integral and unitary.

3. A system in accordance with claim 2 wherein said rear tabs extend longitudinally.

4. A system in accordance with claim 2 wherein said forward stop tabs extend laterally outward from said shelf.

5. A system in accordance with claim 1 wherein said gussets and said gusset tabs are integral, said gussets extend laterally inward from said side supports.

6. A method for assembling a shelf assembly including a shelf and at least one side support, said method comprises:

positioning at least one projecting forward tab and at least one rear tab extending outwardly from the shelf;

positioning at least one side support including a laterally projecting ledge including a rear portion having a first width sufficient to retain the at least one rear tab and a forward portion having a second width less than the first width, each of the rear portion and the forward portion including a top surface and an opposing bottom surface, wherein the forward portion provides a clearance for the at least one rear tab;

positioning a clearance portion in the forward portion having a third width less than the second width, the clearance portion defining an opening extending through the top surface and the bottom surface, wherein the clearance portion provides a clearance for receiving the at least one forward tab;

positioning at least one gusset extending inwardly from each of the side supports, wherein the at least one gusset includes a gusset tab extending upwardly from the gusset;

aligning the gusset tab substantially vertically below a corresponding side support clearance;

positioning at least one support member configured to rigidly connect the side supports and configured to contact the forward tab when the shelf is in a first extended position;

supporting the shelf on the side supports; and slidably coupling the shelf to the side supports.

7. A method in accordance with claim 6 wherein slidably coupling the shelf to the side supports further comprises coupling the shelf to the side supports such that the shelf extends outward in a first direction and retracts inward in a second direction opposite the first direction.

8. A method in accordance with claim 7 wherein slidably coupling the shelf to the side supports further comprises extending the shelf outward till the forward tabs contact the gussets and at least one support member such that additional outward linear movement is prevented.

9. A slide-out shelf assembly comprising:

a shelf comprising a first side, a forward tab laterally extending a first distance from said first side, and a rear tab laterally extending a second distance from said first side, said second distance less than said first distance; and a first shelf side support comprising a laterally projecting ledge for sliding engagement with said shelf first side, said side support further comprises a plurality of support members rigidly connecting said first shelf side support to a second shelf side support and configured to contact said forward tab when said shelf is in a first extended position, said projecting ledge comprising:

a rear portion having a first width sufficient to retain said rear tab; and a forward portion having a second width less than said first width and providing a first clearance for said rear tab and further providing a second clearance for said forward tab, said second clearance having a third width to facilitate releasing said forward tab from said ledge.

10. A shelf assembly in accordance with claim 9 wherein said second width is sized to retain said forward tab when said forward tab is positioned in said forward portion.

11. A shelf assembly in accordance with claim 10 wherein said forward and rear tab extend laterally outward from said shelf first side, and said first side support ledge extends laterally inward over said forward and rear tab when said shelf is in a retracted position.

12. A shelf assembly in accordance with claim 9 wherein said shelf forward tab is configured to be forward of said ledge rear portion and under said ledge forward portion when said shelf is in a fully extended position.

13. A shelf assembly in accordance with claim 12 wherein said rear tab is configured to be under said ledge rear portion when said shelf is in said fully extended position.

14. A shelf assembly in accordance with claim 12 wherein said shelf forward tab is configured to be forward of said ledge rear portion and under said ledge forward clearance portion when said shelf is in a release position.

15. A shelf assembly in accordance with claim 14 wherein said rear tab is configured to be forward said ledge rear portion when said shelf is in said release position.

16. A shelf assembly in accordance with claim 9, wherein said support member is configured to prevent said forward tab from moving forwardly from said first extended position until a forward edge of said shelf is raised.

17. A shelf assembly in accordance with claim 9 wherein said shelf comprises a refrigerator shelf.

* * * * *